US005740649A

United States Patent [19]

Fuchs et al.

[11] Patent Number: 5,740,649

[45] Date of Patent: Apr. 21, 1998

[54] FALSE CEILING

[75] Inventors: Helmut Fuchs, Weil im Schönbuch; Dietmar Eckoldt, Deufringen, both of Germany

[73] Assignee: Fraunhofer-Gesellschaft zur Forderung der Angewandten Forschung E.V., Munich, Germany

[21] Appl. No.: 537,674

[22] PCT Filed: Apr. 20, 1994

[86] PCT No.: PCT/EP94/01277

§ 371 Date: Oct. 19, 1995

§ 102(e) Date: Oct. 19, 1995

[87] PCT Pub. No.: WO94/24382

PCT Pub. Date: Oct. 27, 1994

[30] Foreign Application Priority Data

Apr. 20, 1993 [DE] Germany ..... 43 12 885.8

[51] Int. Cl.[6] ..... E04B 2/00

[52] U.S. Cl. ..... 52/506.06; 52/144

[58] Field of Search ..... 52/506.06, 144

[56] References Cited

U.S. PATENT DOCUMENTS

| | | | |
|---|---|---|---|
| 2,729,431 | 1/1956 | Little | 52/506.06 |
| 2,752,017 | 6/1956 | Segil | 52/506.06 |
| 3,253,082 | 5/1966 | Buset | 52/506.06 |
| 3,390,495 | 7/1968 | Dalby | 52/506.06 |

FOREIGN PATENT DOCUMENTS

| | | | |
|---|---|---|---|
| 233069 | 1/1960 | Australia | 52/506.06 |
| 89165 | 9/1960 | Denmark | 52/506.06 |
| 280134 | 8/1988 | European Pat. Off. | 52/506.06 |
| 1308728 | 5/1987 | U.S.S.R. | 52/506.06 |

*Primary Examiner*—Creighton Smith

*Attorney, Agent, or Firm*—Antonelli, Terry, Stout, & Kraus, LLP

[57] ABSTRACT

A false ceiling for buildings designed to absorb acoustic waves has perforated plates. One or several suspended plates (1, 6) are provided which are so hard that they cannot vibrate. The plates have a plurality of regularly or irregularly arranged holes (4, 7) with 0.2–3 mm diameter, the surface of the holes being less than 4% of the total surface. The air in the holes (4, 7) forms with the overlying cavities (11) a dampening active mass system of the foil absorber type.

11 Claims, 11 Drawing Sheets

FIG. 1(a)
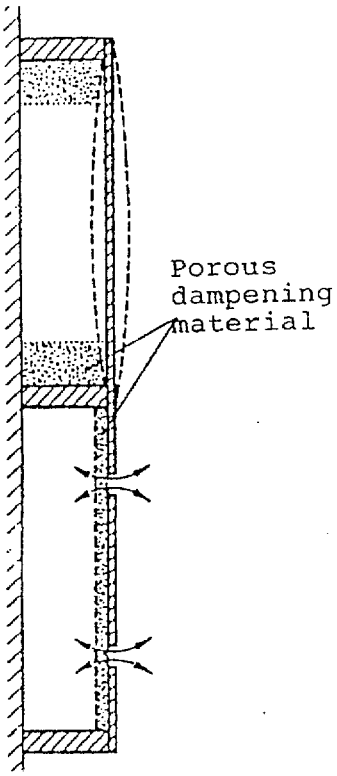
FIG. 1(b)
FIG. 1(c)
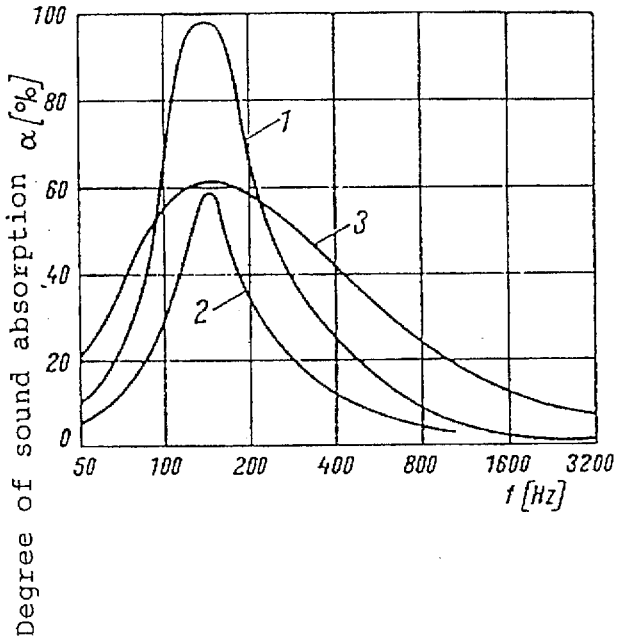
Examples of conventional reactive absorbers according to (1)
(a) Panel resonator (b) Helmholtz resonator
(c) Degree of absorption of (1) $Z \cong pc$ (2) $Z < pc$
(3) $Z > pc$

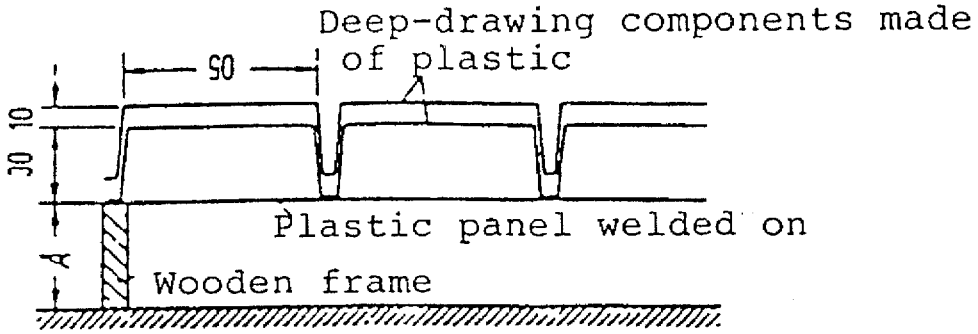
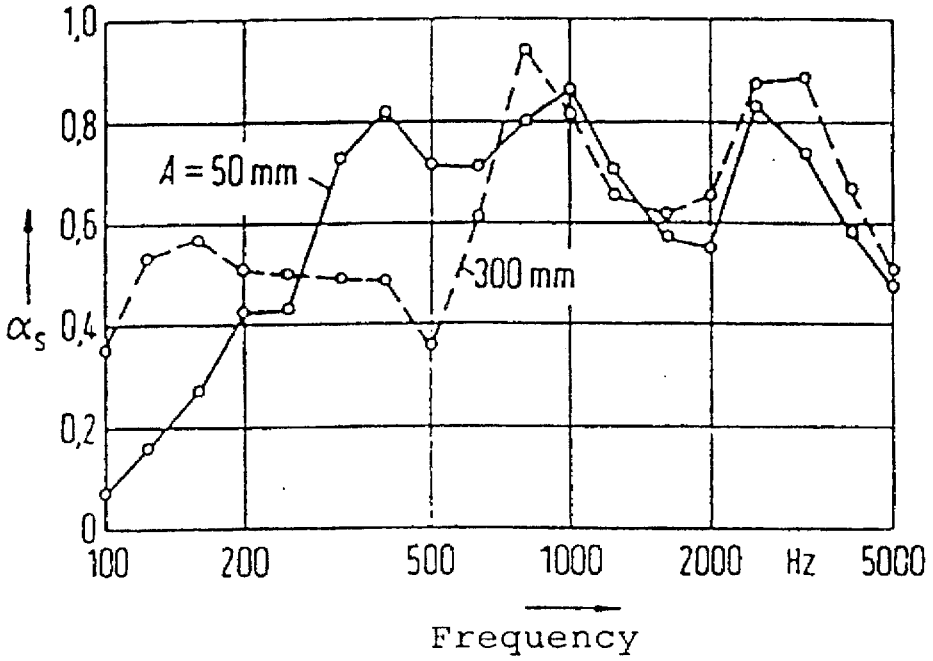
Fig. 2

Fig. 4 Degree of absorption of membrane absorbers according to fig. 3 (but without a covering membrane) having a 50mm thick mineral wool layer.

Fig. 5 Degree of absorption of membrane absorbers according to fig. 3 having a 50 mm thick mineral wool layer.

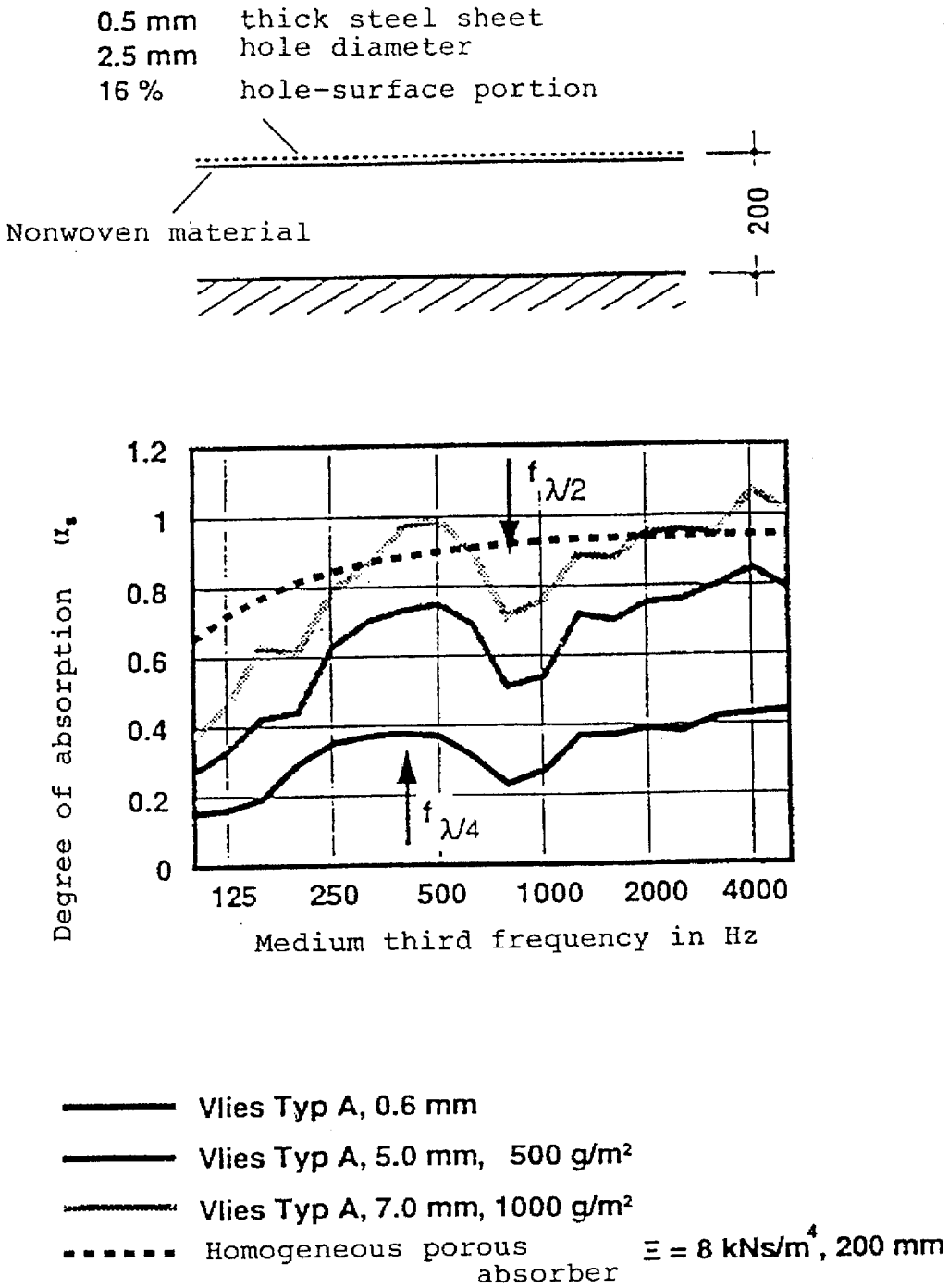
Fig. 7 Degree of absorption of metal sheets having holes having a backing of porous material Degree of sound absorption with perpendicular sound incidence Buildup of the test item:

| Layer Nr. | Thickness d [mm] | |
|---|---|---|
| 1 | 0.5 | microperforated metal sheet No. 1 |
| 2 | 100 | air space |

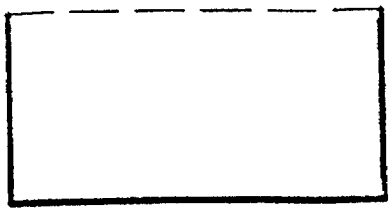

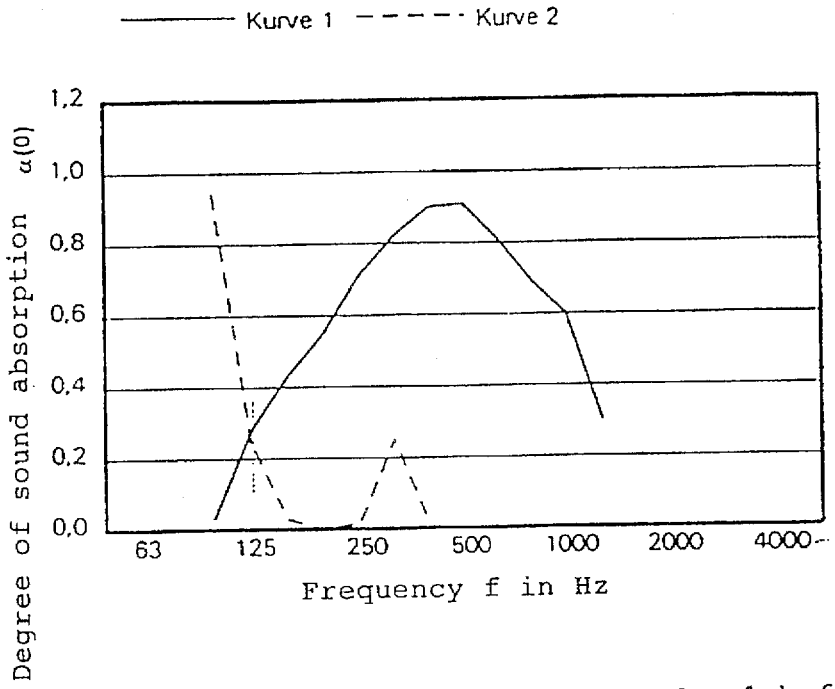

Curve 1: 0.5 mm microperforated steel sheet No. 1 before a 100 mm air space

Curve 2: 0.5 mm steel sheet before a 100 mm air space

Test surface 20 x 20 $mm^2$

Fig. 8 Degree of absorption of a 0.5 mm thick steel sheet (a) as the mass with the air cushion lying behind it resonating like a spring (curve 2)

(b) as a rigid panel having micro holes as the mass with the air cushion lying behind it resonating like a spring (curve 2)

Degree of sound absorption with perpendicular sound incidence
Buildup of the test item:
| Layer Nr. | Thickness d [mm] | material |
|---|---|---|
| 1 | 0.8 | microperforated metal sheet No. 2 |
| 2 | 25 | air space |
| 3 | 0.5 | microperforated metal sheet No. 1 |
| 4 | 75 | air space |
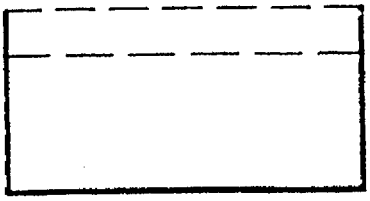
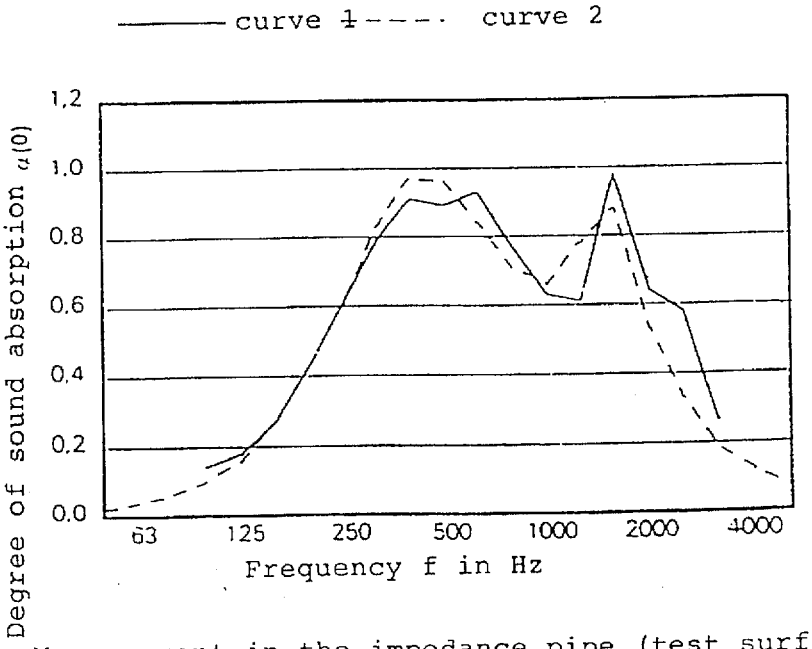
Curve 1: Measurement in the impedance pipe (test surface 50x50mm$^2$)
Curve 2: Calculated values
Fig. 9

Microperforated absorber (aluminium)
Plain panel

— × — Diffuse sound incidence

— . — Perpendicular sound incidence

| t | d | b | D | p % |
|---|---|---|---|---|
| 0,15 | 0,16 | 1,20 | 600 | 1,40 |

FALSE CEILING

BACKGROUND OF THE INVENTION

The present invention relates to a false ceiling, as is known from Frick, O., et al., "Baukonstruktionslehre", Part 1., Teubner, Stuttgart 1992.

1. Subject Matter

Preferably light, for the most part prefabricated, dry and easy to mount ceiling system are being widely employed in a great variety of ways as subconstructions "suspended" from massive, bearing ceilings. In new buildings and in refurbishing lobbies of old buildings, administrative halls, classrooms or industrial, fair or sport halls as well as office buildings, department stores and hospitals, so-called ceiling fronts and false ceilings (FC) have assumed both decorative and construction functions.

2. Purpose and Function

Mounted at a certain distance from the massive ceiling as panelling, the FC often helps meet various physical construction requirements in the building with regard to thermal insulation, fire insulation and soundproofing.

However, it is also suited as a front sheet in adapting the lighting, interior design or acoustics of individual rooms to their specific purpose. Finally, the large hollow spaces between the raw ceiling and the FC are used to cover the laying/integration of pipelines, wiring and inlets and outlets of various building engineering installations.

3. FC Reguirements

High demands are made on false ceilings respectively on the usually plane components of which they are composed in three ways:

3.1 Structural:

(a) high stability, although, light weight, (b) smooth, resistant surface, (c) light, reversible mounting.

3.2 Structural acoustical:

(a) great mass in relation to the surface (5–10 kg/M$^2$).

(b) closed, seamless modular design (50–200 cm)

(c) fibrous/porous hollow space dampening (50–100 mm)

3.3 Room acoustical:

(a) high degree of perforation (20–40%)

(b) fibrous/porous absorber surfacing (10–50 mm)

(c) great suspension height (20–50 cm).

Which of the partially contradicting demands is given precedence depends on the respective function of the room. However, some fundamental problems with FC systems remain unsolved if they are simultaneously supposed to be effective as acoustical ceilings:

4. Drawbacks of Conventional FCs

Even if the FC is supposed to only cover the installations accommodated in the hollow space of the ceiling and itself soundproof the room as described in Frick et al. or in "Trockenbau" July 1992 "Heiss-umkämpfte Kühle", the mineral fiber panels and mats widely utilized as sheet components, ceiling surfacing and hollow space dampening seem to be disadvantageous and obstructive due to their mechanical sensitivity during mounting and installation, health hazard in rooms requiring high health standards, physiological effects due to abrasion and shedding of fibers.

FIG. 1 shows a conventional reactive absorber according to Frick et al., with a) representing a panel resonator, b) a Helmholtz resonator and chart c) the degree of absorption.

The conventional drop and view protection by means of foils having little mass and panels having holes with a high degree of perforation (for room acoustical reasons) contradict the structural requirements to have a not too light front sheet that is as closed as possible on the side facing the room.

The great suspension height of acoustical ceilings required for room acoustical reasons for the absorption of low frequencies according to Frick et al. often contradicts the structural acoustical requirement of small transverse transmission via the hollow space of the ceiling to the adjacent rooms even if the hollow space is filled like a kind of soundproofing with a large amount of fibrous or porous dampening material.

However, if the FC is to serve not only decorative and acoustical purposes, but also to simultaneously assume other building engineering functions as a (low pressure) ventilation ceiling, (radiation) heating ceiling or (surface) cooling ceiling, the fibrous/porous dampening material hitherto essential from an acoustical point of view has a major drawback: it would not only obstruct mounting and installation but also obstruct maintenance and operation of the installations. Therefore, there is an urgent need for FC systems that meets the room and structural acoustical needs without any use of porous absorbers and at the same time accommodates the structural requirements better than conventional acoustical ceilings.

5. Alternative ceiling panel sound absorbers

Conventional acoustical ceilings almost exclusively utilize passive (porous/fibrous) absorbers (Trockenbau July 1992). In order for the airborne soundwaves to be able to penetrate the dampening material unhindered, the ceiling panels have to have a high degree of perforation (15–50%). They can only guarantee a respectively low airborne soundproofing to the ceiling hollow space. Conventional reactive (panel/foil/Helmholtz) absorbers according to FIG. 1 require closed hollow spaces which again have to be filled with dampening material in order to achieve even moderate wideband absorption. Although so-called membrane absorbers according to the requirements of FIG. 2 (cup structure) and FIG. 3 (membrane absorbers) and as described in Fuchs, H. V. "Zur Absorption tiefer Frequenzen in Tonstudios. Rundfunktechnische Mitteilungen rtm 36 (1992), H., 1, p 1–11" obviate the use of porous/fibrous material, they on the other hand still need 5–10 cm deep hollow chambers. Due to their three-shell construction on a relatively small mesh (10–20 cm) honeycomb structure, they are also much too complicated and expensive as a FC component for normal acoustical ceilings. However, the latter can at the most be used as fully enclosed metal cassettes in the hollow space of the ceiling or an integrated FC component to supplement the absorption for low frequencies in rooms with special room acoustical needs.

SUMMARY OF THE INVENTION

The object of the present invention is to create a fiberfree acoustical false ceiling which absorbs wideband frequencies.

The FC component on the basis of staggered plane panels as resonance dampers presented herein combines the properties of microperforated and membrane absorbers in that although it has a practically smooth, closed surface facing the room, the side facing the hollow space does not need own hollow chamber or honeycomb structures, completely obviates the use of porous/fibrous materials.

The new ceiling absorber panels can be utilized suspended as a ceiling front immediately before respectively as a FC from the massive ceiling in all the fields of application detailed under 1. as well as can be provided with all the properties and functions specified under 1. and 2. without possessing the drawbacks mentioned under 4.

The acoustical advantages of the FC system are set forth in the following:

(a) False ceiling as front sheet

Fiberfree FC as a front ceiling (FIG. 10) for increasing airborne and footfall soundproofing of the massive ceiling

- made of thin panels 1, 6 of great density having sufficient surface mass (5–10 kg/m$^2$; e.g., metal, plastic, wood) in which soundwaves cannot excite vibrations,
- having evenly or unevenly disposed small (<2 mm) holes and low hole-surface portion (<2%),
- braced on the hollow space side by bands, ribs 2 (FIG. 10*b*), in such a manner that the passage of sound through the holes remains neglected and sagging of the ceiling panels is prevented even if there are large grid fields (upto 200 cm) respectively between the respective suspenders.

(b) False ceiling as sound absorbers for the room-side sound field

Fiberfree FC as an acoustical ceiling (FIG. 10) for noise reduction and controlling room acoustics

- made of thin panels 1, with the air in the holes in the panels together with the air in the ceiling hollow space 11 executing dampened natural vibrations, preferably at medium and high frequencies, excited by the room-side sound field,
- with panels 1, having evenly or unevenly disposed holes (<2 mm; and hole-surface portion <2%), in which the air together with the air in the hollow space respectively in the hollow space formed by the bracing 2 executes dampened vibrations, preferably in the medium and high frequencies, in the holes excited by the room-side sound field, (c) False ceiling as soundproofing for the airborne sound-transverse conduction in the ceiling hollow space Fiberfree FC as soundabsorbing framing of the ceiling hollow space as a sound transmitting channel which executes dampened vibrations in a wide frequency range excited by the channel-side sound field and thereby contributes to reducing transverse transmission to the adjacent room like the dampening mechanisms described in (b).

The FC component made of even, room-side microperforated, high-density ceiling panels permits complete industrial manufacturing. The extremely small holes permit complete vision protection, the visual impression of a closed ceiling surface and possibilities of decoratively loosening it up.

Preforms of any desired design as reflectors for illumination, inlets and outlets for ventilation and radiators can be made from the fiberfree panel components without having to relinguish their acoustical effectivity.

Microperforated FC systems c an me et the highest sanitary requirements, because

- no porous/fibrous dampening material is involved,
- offers few opportunities for deposition,
- can be wiped and disinfected on the outside and on the inside.

They possess practically ideal prerequisites for mounting, removal and remounting and are completely and inexpensively reversible due to their simple, homogenous installation. If the FC components are made of metal they also comply with the present trend in cooling adminstration buildings and assembly halls in summer: with so-called "cooling ceilings" made of largely standardized metal components high ventilation power consumption, which make up to 50% of the operational costs of conventional air-conditioning, can be easily saved. Therefore it contributes to lowering $CO_2$ emissions and eliminates an often very troublesome source of draft, noise polution and allergies in homes and at the workplace. In the thermal insulation (e.g., aluminium-covered high resistance foam) disposed over the coolant (i.e., water) pipe system the spacing between the cooling lamina and the insulation, the thickness of the lamina, the diameter of the holes, and the number of holes per m$^2$ can be tuned to each other in such a manner that optimum adaption to the reverberation period of the room or to the emission spectrum of the sound sources set up in it can be achieved. The fiberfree, microperforated FC ceiling also offers distinct advantages with regard to heating and ventilation ceilings compared to the conventional systems.

FC components can be installed in a one-sheet, two-sheet or multi-sheet manner. As simple front sheets, they may be completely even and smooth as well as be provided with a decorative pattern and reinforcing beading, edging and folding. If the FC is designed as a suspended coffered ceiling, the hollow spaces of the coffers can be constructed as ventilation channels. The actual rear wall of the coffered ceiling can be advantageously designed from an acoustical and functional vantage point in such a manner that

- varying adjacent hollow space depths are created for widening the absorption effect,
- recesses and molds can be created on the rear side of the ceiling in the actual hollow spaces of the ceiling for holding interior wiring or installation components,
- fresh air, exhaust air and distribution channels can be created on the top side of the ceiling in the coffer hollow space by means of molds and partitions.

BRIEF DESCRIPTION OF THE DRAWINGS

In the following, the present invention as it is illustrated in FIGS. 8, 9, 10, 11 is compared to the state of the art according to FIGS. 1 to 7.

DETAILED DESCRIPTION OF THE PREFERRED EMBODIMENTS

FIG. 1 depicts, as already briefly explained in the preceding, a reactive absorber.

FIG. 1*a* shows a panel resonator in which the panel vibrates as a mass before the air cushion like a spring, however requiring porous material, e.g. as edge damper in order to obtain a somewhat wideband dampening behavior such as in 1*c*.

In so-called foil absorbers according to DE 27 58 041 as shown in FIG. 2, in a very complex cup structure, it was possible to excite a great number of varying panel vibrations in different frequencies in such a manner that an all told wideband absorption spectrum is obtained at medium frequencies even without the use of porous materials.

Figure 4:
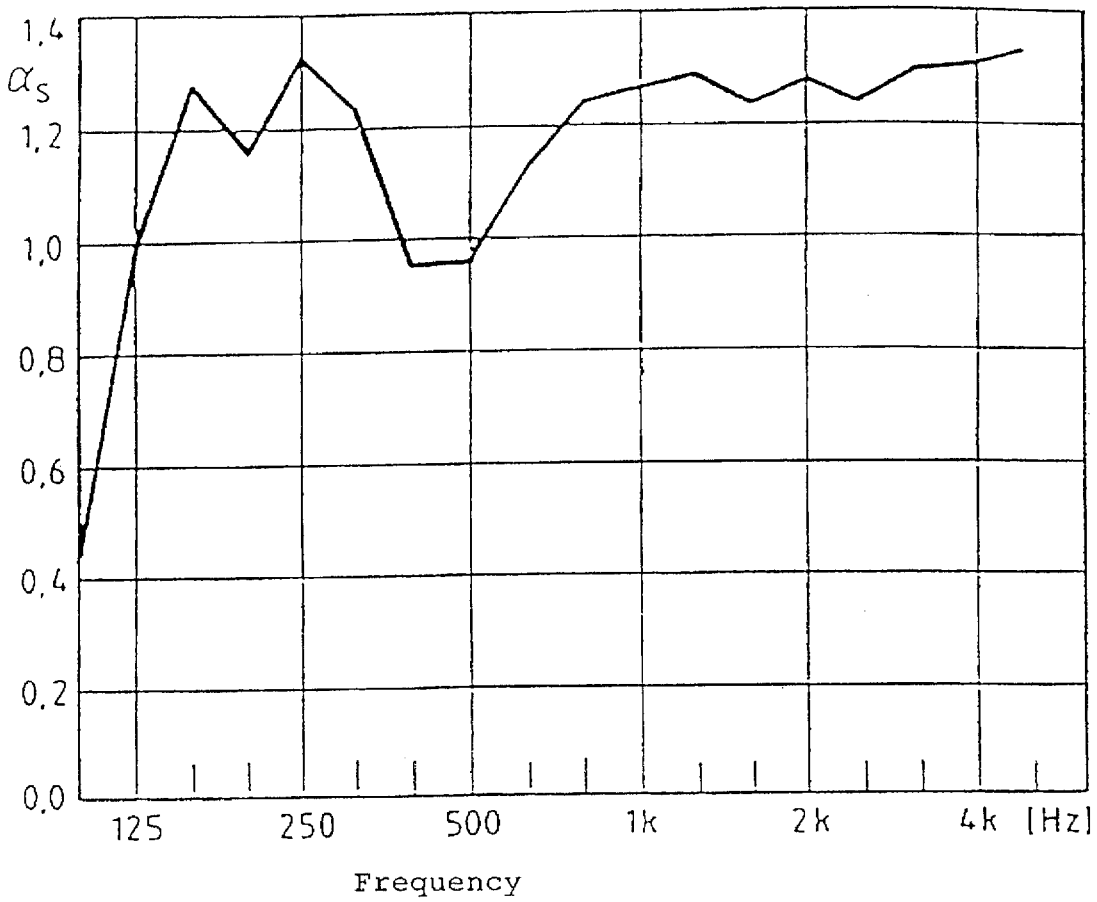
Figure 5:
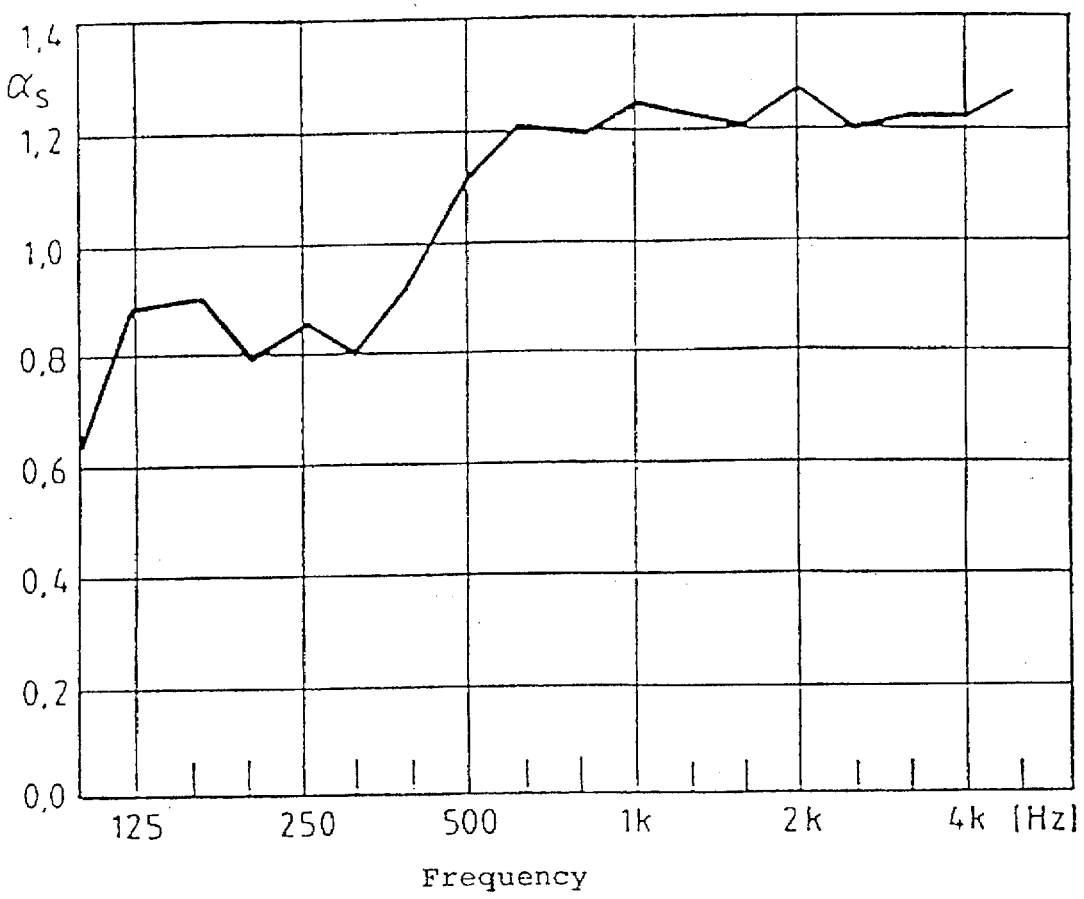

With the so-called membrane absorber, e.g. according to DE 35 04 208 and DE 34 12 432, it was for the first time possible to set up panel and Helmholtz resonators in succession in such a manner that multiple vibrations coupled via multiple air layers and holes already become relatively wideband excitable in a completely plane component. If a relatively thin plane layer (1–5 mm) of porous material is attached before the ceiling membrane of this reactive absorber, as shown in FIG. 3, an increase in absorption at high frequencies can be achieved according to FIGS. 4 and 5.

Figure 3:
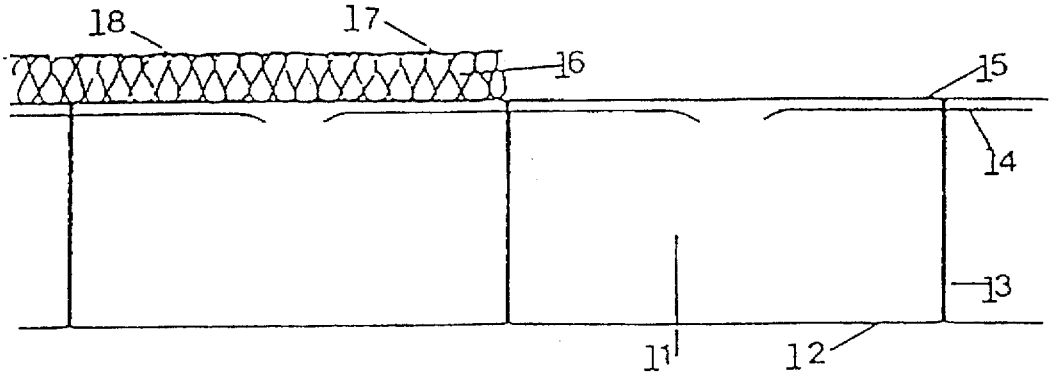

In FIG. 3, 15 stands for the ceiling membrane, 16 for the porous material with a watertight cover 17 respectively with a mechanical protective cover 18. Below the ceiling membrane 15 is the perforated membrane 14 and at a distance the rear wall 12. The ceiling membrane, the perforated membrane and the rear wall are components that can vibrate, thus not rigid panels. The membranes are excited to vibrate and they thereby draw the energy from the sound. The holes in the perforated membrane 14 vary between 3–10 mm. 13 stands for the walls of the honeycomb structure, 11 for the hollow space, which usually is filled with air. This membrane absorber may also be fabricated as a module. The membranes 12, 14, 15 and 13 may be made of plastic or metal.

Furthermore, it is state of the art to cover large-volume porous absorbers with perforated panels, with however the perforated panels only intended as mechanical protection. These porous absorbers are, e.g., pressed mineral fiber panels which are placed behind the suspended false ceiling, with for practical reasons an aluminium foil being glued onto these fiber panels or they being wrapped in a plastic foil. As it is known that penetration of soundwaves into the passive absorber is largely prevented by the foil, it is made "sound permeable" with a multiplicity of small holes by means of "perforation".

Figure 6:
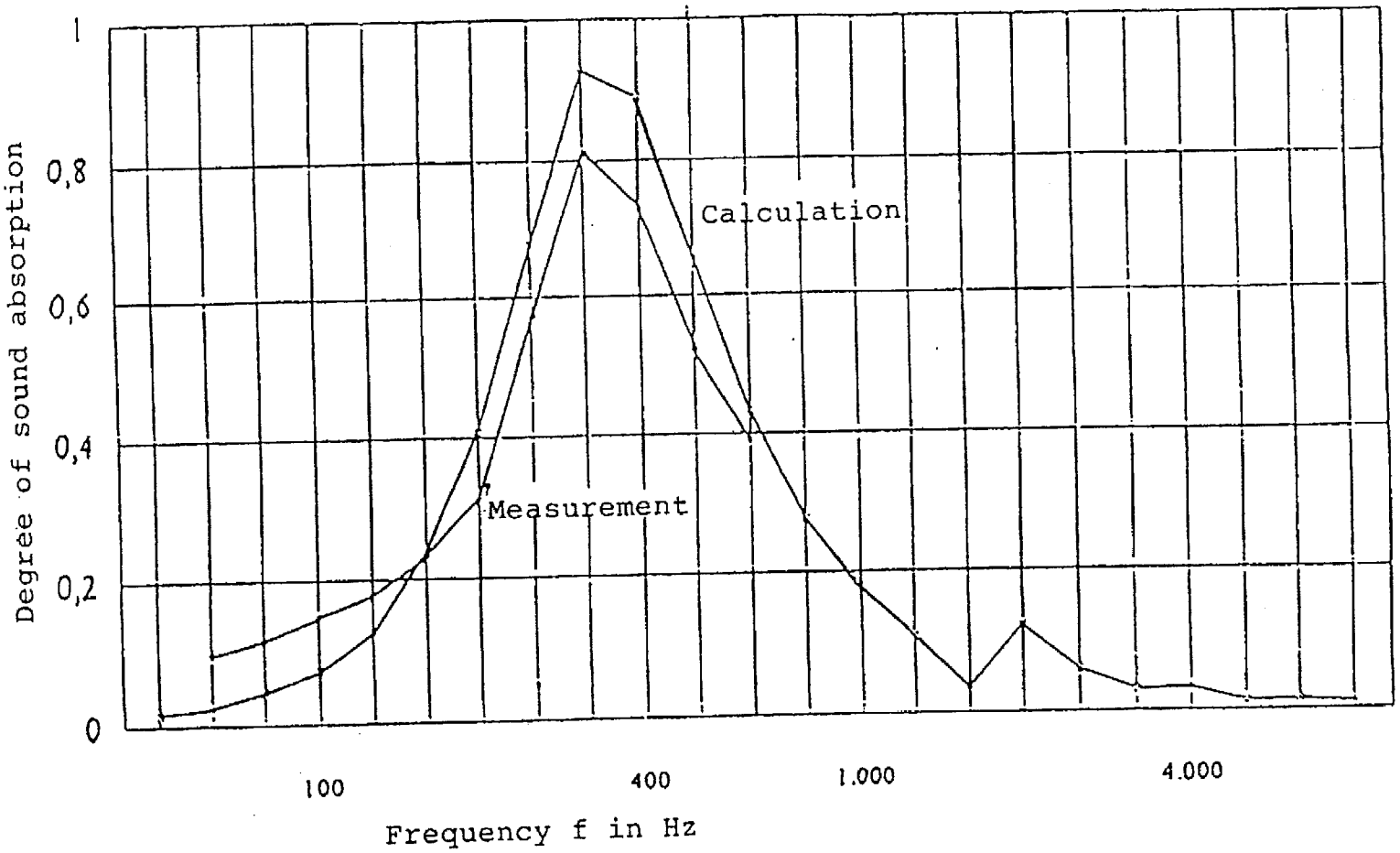

FIG. 6 shows the absorption spectrum according to Maa, D. Y. "Theory and Design of Microperforated Panel Sound Absorbing Constructions", Scientia Sinica 18 (1975), H. 1, 55–71, with a microperforated panel being disposed before a rigid wall. Hitherto, however, this theoretical research has not found technical application anywhere.

Up to now, only in the case of the aforementioned membrane absorbers according to FIG. 3 has it been possible to excite very specific natural vibrations of the plane membranes which adapt well to the honeycomb structure disposed behind it and thereby being able to utilize it for the desired absorption. In the case of the panel resonators with their thick and therefore rigid panels hitherto employed in acoustics, the frequencies of the "higher modes" of the panels before the respective air cushion are far above the frequency of the "basic mode" so that they have hitherto never been utilized for absorption of sound energy from the room. If these membrane absorbers are manufactured for flow channels, e.g., in air conditioners, the panels are usually manufactured thinner. The soundwaves in the channel are "swallowed" from the start much stronger far above the mass/spring resonance frequency by the alternately (about the channel) disposed purely passive absorbers than by any higher modes of the panels themselves. Even if the latter could be excited in an interesting frequency range near the basic frequency corresponding to the panel dimensions, these vibrations would not be able to develop properly at all due to the mineral-wool filling pressing against the full surface on one side. This was probably also the reason why it has not been attempted to make higher modes in the microperforated absorber according to FIG. 6 excitable with the aim of widening the effective frequency range.

Compared to this state of the art, the present invention relates to a false ceiling having at least one microperforated metal panel or a microperforated plastic panel before a non-vibrating wall 5 or rear wall 7 which does not need the disposal of any sound swallowing elements or additional porous or fibrous dampening materials in the air space.

Countless false ceilings having perforated metal panels are described in "Trockenbau" July 1992, in which "a sound swallowing backing made of mineral wool for adaption to the acoustical requirements" (p. 2, lines 24–26), which (the mineral wool) lies immediately with its whole surface on the panels having holes. The applicant of the present invention has repeatedly measured such systems in an acoustic room, because they are employed in industry as false ceilings. FIG. 7 shows such a system with its absorbtion spectrum, the system having 0.5 mm thick steel sheets, 2.5 mm hole diameter and 16% hole-surface portion, with the sheet being disposed about 200 mm below the ceiling. One can see that the nonwoven material has a considerable proportion of the absorption in the higher frequency ranges. The absorption frequency f../4=Co/4D (with Co=sound velocity and D the space between the panel and the rear wall) has as expected an increased absorption compared to the frequency ../2. This indicates that the achieved absorption is due to the dampening material lying on the false ceiling. The air in the holes of the false ceiling transmits only the sound vibrations of the soundwaves incident on the metal sheets having holes into the dampening material lying behind it. It is not until there that the sound energy is converted into heat by the friction on the fibers or in the pores of the dampening material and the sound energy is reduced thereby.

The problems involved with conventional sound absorbers, in particular, in view of the fact that recent research results indicate that the sound dampening material, e.g., rock wool or glass wool, is carcinogenic as well as moisture absorbent, dust forming and abrasive, have led to a search of new possible ways of sound dampening. On the other hand, the membrane absorbers have been known for quite some time. However, as they are more expensive than the relatively more economical materials made of rock wool or glass wool, they could not prevail. Moreover, membrane absorbers, whether in their cup-shaped manner of design or in the previous manner of construction with cleaved surfaces, in order to widen the absorption spectrum, are relatively complicated and therefore expensive.

In comparison, the invented false ceiling is simple to manufacture, simple to mount and inexpensive, because it is only composed of finely perforated metal sheets and the laterally bordering surfaces of the air space and the plane rear wall respectively panel. The holes having a diameter of 0.2–3 mm, preferably less than 2 mm, more preferably 0.2–0.8 mm, most preferably 0.4–0.8 mm are not intended as "openings" for as unimpeded as possible entry of sound energy into the air space between the false ceiling and ceiling. The, for the invented purpose, extremely small hole-surface portion of maximal 5%, preferably less than 4%, more preferably 0.5–3%, most preferably less than 2%, would be even less suited for the (passive) transmission of sound energy from the room into the intermediate space than the openings according to the state of the art, because these have a hole-surface portion between 15–50%. Instead the air in the holes of the microperforated metal sheet according to the invention in conjunction with the air cushion in the intermediate space acts like a very special mass-spring vibration system, which can be made to excite vibrations in the respectively interesting frequency range by the sound field (reactive) incident on the microperforated metal sheet. The tuning to the respective frequency range occurs by the completely purposeful selection of geometric parameters, in particular the thickness of the perforated metal sheet, thickness of the air space, the diameter of the holes, the spacing of the holes, the shape of the holes, the proportion of the perforation in the overall surface of the perforated metal sheet and the shape of the metal sheets.

In particular, the selection of the hole configuration not only determines the frequency range of the absorption but also the effectivity of the absorbers in this frequency range. The necessary dampening is not achieved according to FIG. 1*a* or FIG. 7 by attaching additional porous or fibrous "swallowing materials", but rather exclusively by friction of the air particles on the walls of the small holes. The desired frequency range and the required friction can therefore be optimumly adapted to the respective application in such a manner that almost total absorption of the incident sound energy becomes possible. The panels are constructed so thick and stable that incident soundwaves cannot excite vibrations in them. Without the microperforations of the invented type, the panels, to the extent that they are designed able to vibrate as shown in FIG. 8, would resonate like a spring-mass system at most at very low frequencies and only narrowband according to the interrupted curve 1 and absorb thereby the sound. On the other hand, the microperforation, curve 2, results in a relatively wideband absorption at medium and high frequencies according to FIG. 8, because the light air in the holes resonates as mass with the air in the hollow space as the spring. With two successively disposed, rigid microperforated panels, as FIG. 9 shows, permits achieving an even wider absorption spectrum without having to add additional dampening material or stationary components like a resonator having to resonate.

Figure 10A:
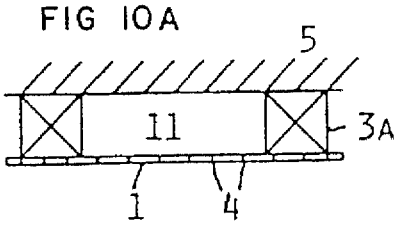
Figure 10B:
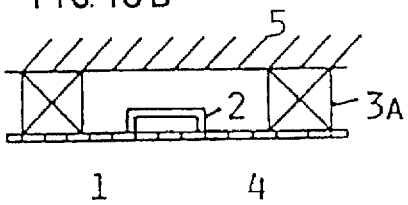
Figure 10C:
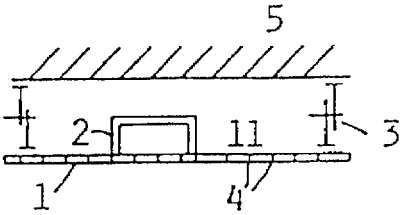
Figure 10D:
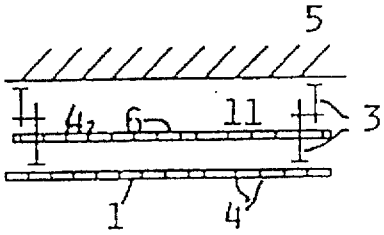
Figure 10E:
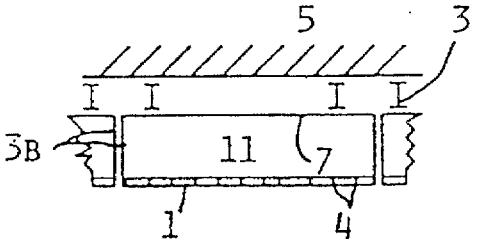

FIGS. 10*a–f* show the invented false ceiling, with FIG. 10*e* showing the false ceiling as a module which can then be attached as a false ceiling in a coffered manner under the ceiling.

In FIG. 10, 1 and 6 stand for the plane microperforated panel made of sheet metal or hard plastic having holes 4, and 7 stands for a vibratable panel as the rear wall of the module. 3*b* stands for the rigid frame of the module, and 11 stands for the hollow spaces or intermediate spaces filled with air. 3 are the suspensions and 3*a*, e.g., beams or a subconstruction for supporting the false ceiling respectively front sheet. As the panels or modules were delivered in units of approximately 1 square meter, varying spacings D of the false ceiling to the rear wall can be realized via the suspensions 3 or subconstruction 3*a*, whereby the absorption spectrum is widened. 2 stand for the reinforcements of the panels 1, 6, which of course can also be disposed over the entire length and width of the panels in such a manner that it does not vibrate.

Figure 11:
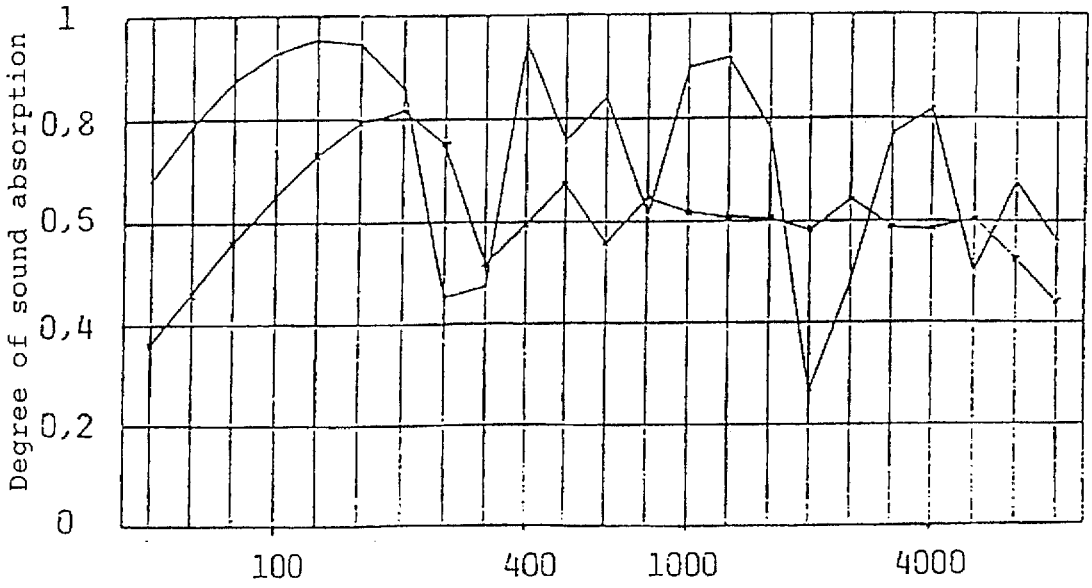

FIG. 11 shows the spectrum of microperforated panels made of aluminium with a thickness of the panel t of 0.15 mm, hole diameter of 0.16 mm, hole spacing of 1.2 mm and thickness of the air layer in the intermediate space between the panel and the rear wall or the ceiling of 600 mm and a hole-surface portion p of 1.4% given by the diameter of the holes and the spacing.

Figure 10F:
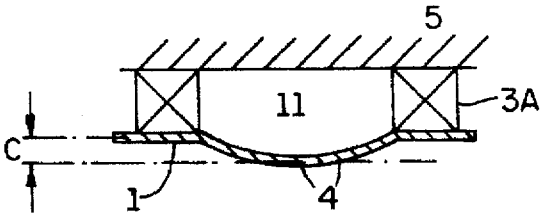

With a desired resonance frequency of $f_R=54\times10^3\sqrt{\alpha/D.f.K_m}$ according to Maa's theory, with $\sigma$ the hole surface/overall surface, D the air layer thickness in the intermediate space and $K_m$ a constant, which is proportional to the hole diameter multiplied by the root of f, the parameters panel thickness, hole surface portion respectively the number of holes with a specific hole diameter and air space D can be varied within certain limits. Thus with an aluminium panel 3 mm thick, a hole-surface portion of p=1.4 and an air space of D=50 mm results in a hole diameter of 0.45 mm. If the holes are of a uniform size, but the number of holes is increased, according to the theory the resonance frequency shifts to higher frequencies. This can also be achieved with smaller holes. Furthermore, a widening of the spectrum is achieved if the panel is slightly curved downward as shown in FIG. 10F, e.g., with a panel width of 1000 mm and a curvature c of 60–80 mm.

What is claimed is:

1. A false ceiling for rooms in buildings, which is designed to absorb soundwaves, comprising a perforated panel having sufficient construction so that sound waves in the building do not excite vibrations in the panel and having a multiplicity of holes having a diameter d of 0.2–3 mm and a hole to surface portion of less than 4%, and suspensions or subconstructions for attaching the perforated panel to the buildings, wherein air in said holes forming with air in hollow spaces situated thereabove a spring-mass system and wherein additional porous or fibrous damping material is not included.

2. A false ceiling according to claim 1, wherein said holes have a hole to surface portion of less than 2%.

3. A false ceiling according to claim 1, wherein multiple panels are provided and said panels are disposed at an increasing distance D in relation to the ceiling.

4. A false ceiling according to claim 1, wherein said panels are composed of plastic, composites or metal.

5. A false ceiling according to claim 1, further comprising reinforcements in order to prevent sagging of said panels.

6. A false ceiling according to claim 1, wherein said panels are attached to a lateral frame and a plane rear wall designed as a module.

7. A false ceiling according to claim 1, wherein said hole to surface portion is 0.5 to 3%.

8. A false ceiling according to claim 2, wherein said holes have a diameter of 0.2–0.8 mm.

9. A false ceiling according to claim 2, wherein said holes have a diameter of 0.4–0.8 mm.

10. A false ceiling according to claim 7, wherein said holes have a diameter of 0.4–0.8 mm.

11. A false ceiling according to claim 1, wherein said perforated panel has a downward curvature.

* * * * *